US005380131A

United States Patent [19]

Crawford

[11] Patent Number: 5,380,131

[45] Date of Patent: Jan. 10, 1995

[54] SYSTEM FOR CORROSION PROTECTION OF MARINE STRUCTURES

[75] Inventor: David W. Crawford, Houston, Tex.

[73] Assignee: MPT Services, Inc., Houston, Tex.

[21] Appl. No.: 22,513

[22] Filed: Feb. 25, 1993

[51] Int. Cl.[6] ..... E02D 5/60; E02D 31/06

[52] U.S. Cl. ..... 405/216; 52/725; 52/727; 405/211; 138/98

[58] Field of Search ..... 405/216, 211, 195.1, 405/303; 52/727, 514, 728; 138/98

[56] References Cited

U.S. PATENT DOCUMENTS

| | | | |
|---|---|---|---|
| 2,200,469 | 5/1940 | Cox | 204/1 |
| 2,470,149 | 5/1949 | Derby | 405/216 |
| 2,897,553 | 8/1959 | Gorron | 405/216 |
| 3,370,998 | 12/1968 | Wiswell, Jr. | 156/71 |
| 3,719,049 | 3/1973 | Shaw et al. . | |
| 3,996,757 | 12/1976 | Liddell . | |
| 4,019,301 | 4/1977 | Fox | 52/725 |
| 4,244,156 | 1/1981 | Watts | 405/216 |
| 4,283,161 | 8/1981 | Evans et al. | 405/216 |
| 4,439,071 | 3/1984 | Roper | 405/216 |
| 4,445,806 | 5/1984 | Crain | 405/216 |
| 4,527,928 | 7/1985 | Rutherford et al. | 405/211 |
| 4,614,461 | 9/1986 | Taniguchi et al. | 405/211 |
| 4,619,557 | 10/1986 | Salama et al. | 405/211 |
| 4,629,366 | 12/1986 | Rutherford et al. | 405/211 |
| 4,634,314 | 1/1987 | Pierce | 405/195 |
| 4,743,142 | 5/1988 | Shiraishi et al. | 405/216 |
| 4,918,883 | 4/1990 | Owen et al. | 405/216 |
| 5,087,154 | 2/1992 | Crawford | 405/216 |

FOREIGN PATENT DOCUMENTS

| | | | |
|---|---|---|---|
| 58496 | of 1983 | Japan | 405/216 |
| 1439214 | of 1976 | United Kingdom | 405/216 |

*Primary Examiner*—Dennis L. Taylor
*Attorney, Agent, or Firm*—Daniel Rubin

[57] ABSTRACT

A system of corrosion protection and a method of applying the protection on items to be used or being used in marine environments and otherwise susceptible to the deleterious effects of erosion and/or corrosion. The protection is comprised of a coating formed of a polyamine converter and an epoxy resin that can be applied either to virgin metal or to pre-existing metallic items immersed below sea level and a rigid cladding such as fiberglass reinforced pipe encapsulating the coating. Where on site restoration of an item is to be performed, some or all of the coating and cladding application can be conducted underwater by preceding the applications with an abrasive blasting of the surface to be protected.

23 Claims, 1 Drawing Sheet

SYSTEM FOR CORROSION PROTECTION OF MARINE STRUCTURES

FIELD OF THE INVENTION

The field of art to which the invention relates comprises the art of corrosion protection for structures being used or to be used in marine environments.

BACKGROUND OF THE INVENTION

Installation of various type metal structures in corrosive liquids such as sea water are confronted with a major problem in avoiding the adverse effects of corrosion and erosion. Either can severely reduce the life expectancy of the structure. Exemplifying the situation are structures such as off-shore rigs and/or production platforms for recovering oil in the many oceans and seas of the world. Briefly, such structures include not only supports for the rig itself, but also risers comprising conduits through which transmission of recovered oil or gas is conducted. Typically, the various structural items and/or risers are pre-coated, encased or otherwise provided with cathodic protection or the like in order to ward off or deter the deleterious corrosive effects of the sea water. Little had been known however, how to restore such risers on site after the onset of corrosion when the original protective coating, etc., had begun to wear or generally deteriorate. Temporary repair or replacing the affected structures had been customary although undesirable because of the associated high costs and less than satisfactory results.

BACKGROUND OF THE ART

There have been many attempts to passivate the adverse effects of impact/abrasion and corrosion to structural members of offshore platforms, drilling rigs, pipelines, risers, pilings, wharfs, or any edifice that is located in the splash or tidal zones of a marine environment. There are several known techniques for applying pre-installation protection to metallic structures for protecting them from the ultimate effects of corrosion and erosion that attack the supports of the structure located in the splash zone. By way of example, steel pilings and/or production piping are usually covered with a rust-resistant inorganic zinc silicate primer and organic top coats as a coating system during the fabrication phase of new construction. Exemplifying such coatings are the disclosures of U.S. Pat. Nos. 3,370,998; 4,619,557; and 4,743,142.

Once a structure such as a production platform is emplaced offshore and subjected to prolonged exposure of the marine environment during normal operating procedures, previously coated steel surfaces tend to become slowly penetrated and eroded to a point whereby the existing steel substrate is ultimately exposed. The corrosion rate of steel in the splash zone is typically about 100 mils per year. Normally these steel support members, without good repair procedures, will lose their structural integrity after about seven to ten years of exposure. The replacement cost of risers and other steel supports in situ offshore are considered extremely expensive such that replacement is preferred to be avoided.

over the last couple decades, coating manufacturers have formulated epoxy resins that will cure under water. These materials were primarily developed for spot repair usage and have enjoyed some limited success on small projects. Historically, these formulations are based on polyamide cured epoxy resins that are heavily filled with inert inorganic compounds, i.e., silica flour or mica, to produce increased viscosity, thixotropy and solids by weight. These properties are essential in order to reduce the possibility of the material being "washed off" by encounted wave action.

Despite existence of such conventional underwater epoxy formulations, a problem has been a lack of sufficient adhesion of the epoxy with the applied surfaces. The end result has been a more or less "envelope" effect, whereby the coating does not bond tenaciously to the substrate surface particularly in repair situations where an onset of corrosion or erosion has already been encountered. Under those circumstances, indiscriminate delamination or spalling usually occurs within the first year after application.

In my prior U.S. Pat. No. 5,087,154 there is disclosed a coating composition and method of applying the coating to items being used or to be used in a marine environment. The coating tenaciously adheres to the recipient surface and is comprised of a plurality of layers of epoxy composition sequentially applied about the affected surface area. A vitrified cloth wrap is disposed between each layer of epoxy.

OBJECTS OF THE INVENTION

It is therefore an object of the invention to provide an improved system for affecting protection against corrosion and erosion of support structures in a marine environment.

It is a further object of the invention to achieve the previous object with a coating and encapsulating cladding structure that can be applied on site and underwater more quickly and with less labor intensity than previously possible.

It is a still further object of the invention to achieve the previous objects with an adhesion type barrier coating continuously maintained in a compression relation by the encapsulating cladding.

SUMMARY OF THE INVENTION

This invention relates to a novel system and method of application for effecting corrosion protection of marine structures. More specifically, the invention relates to a novel such system and method of applying the protection to afford superior corrosion and erosion protection to a support structure to be used or being used in a marine environment. The installation can be either pre-applied during initial fabrication or post-applied on site to existing support structures in need of repair or restoration. In either situation, the life expectancy of the structure upon which the protection hereof has been installed can typically be increased by at least about five years over the otherwise current life expectancy of such structures. At the same time, the protection can be installed more quickly and with less labor intensity than disclosed, for example, in my prior U.S. Pat. No. 5,087,154 incorporated herein by reference.

The system hereof for achieving the foregoing enables a continuous application of a uniform uninterrupted epoxy coating over the surface area to be protected. A rigid cladding surrounds and encapsulates the coating so as to place the coating in compression. Prior to placement of the cladding the uncured epoxy is concomitantly applied both to the surface area and to the interior surface of the cladding. Preferably, for an item of circular cross-section, the cladding is in the form of half shells comprised of arcuate sections of impervious reinforced thermosetting resin pipe (RTRP) or fiberglass resin pipe (FRP).

The coating is comprised of a solvent-free, 100 percent solids by volume epoxy polyamine adhesive that is applied either to surface prepared virgin metal as a fabrication coating or, in the case of restoration, over a previously abrasive blasted metallic substrate that is free of scale, oxidation and/or chemical contamination. The utilized polyamine formulations of epoxy adhesive provide characteristics that displaces water and creates a strong molecular attraction or adhesive strength to the substrate. The cladding enables a uniform circumferential compression of the coating squeezing out excess water and trapped air. Being an impervious outer shell encapsulating the coating, it affords superior resistance to impact, abrasion and erosion not adversely affected by salt water. As such, it complies with ASTM F927 "General Marine Services".

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
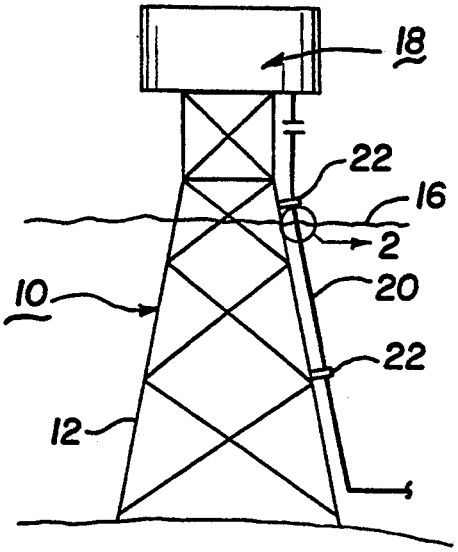
FIG. 1 is a schematic illustration of a typical offshore platform.

In the description which follows, like parts are marked throughout the specification and drawings with the same reference numerals, respectively. The drawing figures are not necessarily to scale and the proportions of certain parts may have been exaggerated for purposes of clarity.

Figure 2:
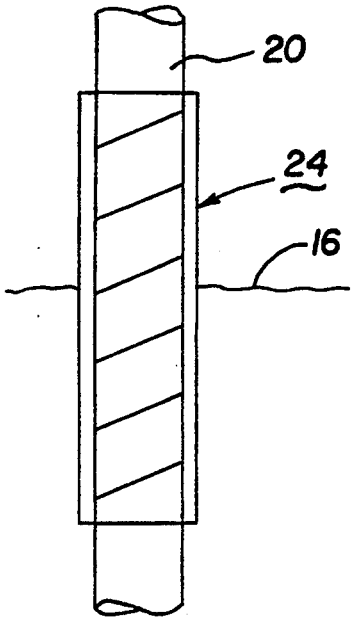
FIG. 2 is an enlarged fragmentary section of the encircled portion 2, of FIG. 1.
Figure 3:
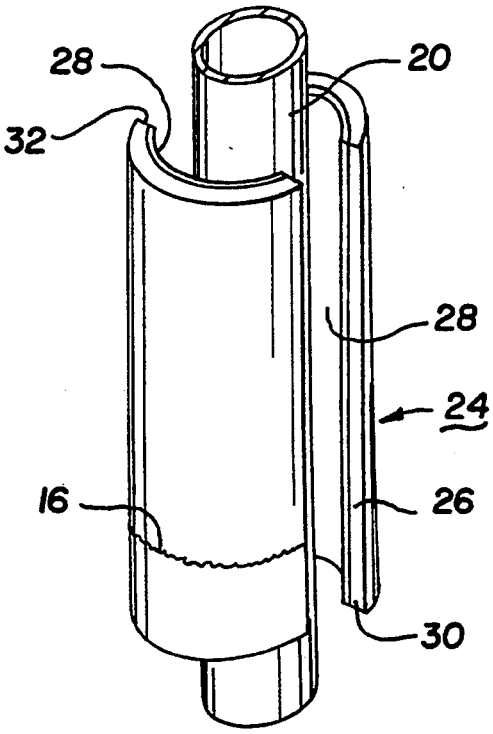
FIG. 3 is an enlarged isometric exploded view of the installed protection hereof.
Figure 4:
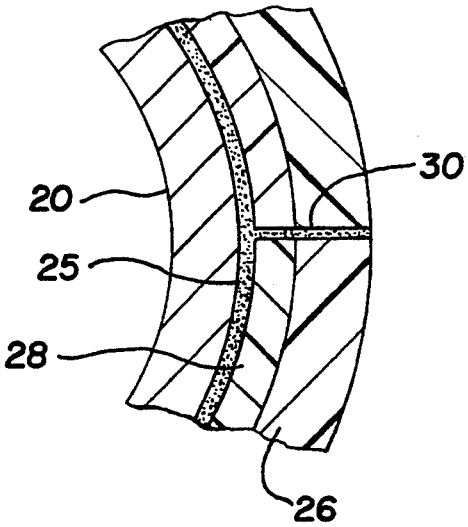
FIG. 4 is fragmentary substantially enlarged section of the completed installation.

Referring now to the drawings, there is illustrated in FIG. 1 an exemplary use of the coating and method hereof as represented by an offshore platform designated 10 secured via a support structure 12 to the sea bottom 14. Above sea level 16, there is provided a working deck 18 from which a pipeline riser 20 dependently extends while secured via clamps 22 to the support structure 12. For inhibiting the adverse effects of corrosion and erosion in the splash or tidal zone there is provided on riser 20, as illustrated in FIGS. 2 and 3, the system of the invention designated 24 includes a coating 25 encapsulated with a cladding 26.

As will be understood, the coating 25 with cladding 26 are useful as a preliminary protection applied during initial fabrication prior to installation of riser 20. Alternatively, they can be applied for restoration purposes during post-installation service on site following some initial deleterious onset of corrosion and/or erosion effects on the riser. During fabrication, the coating and cladding can be applied directly to abrasively blasted virgin metal as a substitute for other inhibitive type coatings of a type which have been applied for many years or can be applied in combination therewith.

For restoration or repair of existing structures, the affected surface is first abrasively blasted above and below water level to a near white finish in accordance with the Steel Structures Painting Council (SSPC-SP10). This has the effect of removing all rust, oxidation, scale and chloride contamination from the riser surface. Depth of anchor profile should be a minimum of at least about 3 mils so as to remove imbedded contaminants consisting of mil scale (new steel) or $Fe_2O_3$, chlorides, chromates and nitrates that exist on deteriorated steel.

Comprising coating 25 is a solvent free, 100 percent solids by volume epoxy polyamine adhesive composition formulated for underwater curing. An essential property thereof is the tenacious adhesive characteristics it assumes when applied directly to a properly prepared steel substrate. This has been achieved herein with an epoxy resin (A) and converter (B) mixed together in equal proportions from the following ingredients:

(A) (percent by volume)
a) Bisphenol-F epoxy resin (about 80–95%)
b) fumed silica (about 5–10%)
c) coloring matter such as carbon black (about less than 5%)

(B) (percent by volume)
a) polyamine compound (about 80–95%)
b) alkyl substituted amino-phenol (about 5–15%)
c) barium sulphate (about 5–10%)
d) organic acid (less than about 5%)

The epoxy resin (A) when mixed with the converter reactor develops a very high degree of molecular attraction through exothermic polymerization to the steel substrate. The phenomenon is sometimes termed "good wetting", i.e. the surface of steel contains multiple layers of water molecules and this composition provides molecular attraction by diffusing through those water layers by emulsification (or disperses the water through the adhesive so that contact to the steel is accomplished.) It is an essential step that an adequate degree of adhesion develop during the curing state. Emulsification is attributed to the hydrophobic fatty acid portion of the polyamine molecules, which in combination with the hydrophilic portion of the molecule acts as the emulsifier.

Characteristically, the resulting epoxy composition is able to withstand temperatures of down to 45° F. and pressures to at least 1,500 pounds per square inch without adversely affecting its curing capabilities. Whether applied to new riser structures prior to installation or to post installed structures subsequent to abrasive blasting, the two-part epoxy formulation with preferably a black and white pigmentation respectively is first mixed in equal proportions. When properly mixed, the epoxy will appear as a uniform dark gray color with a consistent smooth viscosity free lumps or undissolved particles having a workable pot life approximately forty minutes at 80° F.

Cladding 26 is comprised of reinforced thermosetting resin pipe (RTRP) or fiberglass resin pipe (FRP) custom sized as to ID and wall thickness. The pipe composition is one having optimum compatibility with the composition of coating 25 and in a preferred composition is comprised of an epoxy amine resin, glass filament wound procedure and then heat cured. Once cured, the pipe is cut into two arcuate clam shell sections and the ID is abrasive blasted to provide an anchor or surface profile.

For centering the cladding pipe and affording a substantially concentric annular space between the OD of riser 20 and the ID of cladding 26, centralizers 28 are initially formed on the ID substrate of cladding 26. The centralizers are comprised of dimensionally controlled segments of coating composition 25 applied and cured on cladding 26 at least 24 hours prior to installation. The centralizers function as stand off projections about $\frac{1}{8}$ inches to $\frac{1}{4}$ inches in thickness throughout the longitudinal axis of both halves of cladding 26 and are about 2–3 inches in length. When the cladding is installed they are spaced systematically throughout the entire annular space thereby enabling the applied coating 25 to fill any void spacing.

Subsequent to preparation of the epoxy mixture, the first step is to apply concomitantly a controlled quantity of still viscous epoxy mixture uniformly about the surface of riser 20 above and below the water line and to the ID surface of cladding halves 26. Application of the mixture to the exterior surface of riser 20 can be by hand or roller. To the cladding, while preferably out of the water, it is generally applied by roller or brush. The combined coating thickness should be at least sufficient to obtain a continuous filling of the annular spacing between the OD of the riser 20 and the ID of the cladding 26. A preferred thickness is about 50–70 mils.

Once both surfaces contain the requisite thickness of epoxy mixture, the cladding halves are disposed about the affected riser area insitu and clamped by annular clamps (not shown). As the clamps are emplaced and tightened, the developed compression forces excessive quantities of the mixture along with water and air from the annulus out the top and bottom and through the two longitudinal seams 30 and 32 between the cladding halves. The volume of the affected annular space will, of course, vary as a diametral relation of the riser and cladding. The clamps are usually of steel and are left to disintegrate in salt water after several months. Optionally, nylon straps could be utilized instead of clamps.

The coating cure rate will vary with atmospheric and water temperatures. At 80° F. the system will cure hard within about two hours. Final cure above and below water normally occur within 24 hours when applied in water temperatures of at least about 55° F. Most installations are performed by a trained and competent painter in the minus (−)3 to (−)5 foot level in the splash zone. When water depth exceeds about five feet, installation usually requires special equipment and the use of divers. It is anticipated that the process hereof can be successfully applied to water depths of at least 100 feet.

When the system hereof has been properly installed, it is anticipated to extend initial life expectancy of the recipient structure for at least five additional years compared to prior coatings initially applied for that purpose. At the same time, the benefit in a restoration situation is anticipated to be far superior to repair methods previously utilized by extending the practical life of the structure for at least five additional years. Even then, should subsequent breakdown of the installation occur, additional restoration can be re-applied over a space of time when required any number of times for so long as the basic structural integrity of the metal structure of riser 20 remains.

By the above description, there is disclosed a novel system for affecting corrosion protection of marine structures. By forming an epoxy coating composition having superior adhesion properties and encapsulating the composition with a firm and rigid cladding of fiber glass resin pipe, unusually long-lasting barrier protection is achieved. When constructed in this manner, the resultant installation is sufficiently durable to withstand anticipated erosion effects for prolonged time periods, during which it is unpenetratable by sea water. At the same time, it greatly expedites the installation time while being less labor intensive, particularly in the sub sea or rising/falling tidal action as compared to the method and installation described in my prior patent mentioned supra. Moreover, the cladding provides superior resistance to impact, abrasion and erosion than previously attainable.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A system of corrosion protection for a corrosion susceptible item adapted for use in a marine environment, said system comprising a layer of a cured marine resistant epoxy composition applied uncured onto a select surface portion of the item, a cladding formed of rigid individual sections applied juxtaposed to each other against the epoxy when uncured for substantially encapsulating said layer collectively and clamping means operative when said epoxy is uncured to secure the cladding sections in a compressive relation against said epoxy with a level of compressive force sufficient to cause a quantity of the uncured epoxy to exude past said cladding.

2. A system of corrosion protection in accordance with claim 1 in which said cladding is permanently secured to said epoxy and comprises impervious arcuate sections of filament glass resin pipe assembled to encapsulate said epoxy layer.

3. A system of corrosion protection in accordance with claim 2 in which said pipe resin is of a composition chemically compatible with the composition of said epoxy layer.

4. A system of corrosion protection in accordance with claim 3 in which said cladding pipe composition comprises fiberglass reinforced amine resin impregnated with a filament wound glass.

5. A system of corrosion protection in accordance with claim 3 in which said cladding pipe includes centralizers selectively pre-applied about its internal surface to effect substantially uniform positioning about said item.

6. A system of corrosion protection in accordance with claim 5 in which said centralizers comprise segment lengths of second epoxy layers pre-cured on the internal surface of said cladding pipe sections.

7. A system of corrosion protection in accordance with claim 3 in which said epoxy layer comprises a two-part mixture in substantially equal proportions of a polyamine converter and an epoxy resin operative to adhesively secure to said select surface portion.

8. A system of corrosion protection in accordance with claim 7 in which said epoxy resin is comprised in percent by volume Bisphenol-F epoxy resin (about 80–95%); fumed silica (about 5–10 %); and coloring matter (about less than 5%); and said converter is comprised in percent by volume of polyamine compound (about 80–95%); alkyl substituted amino-phenol (about 5–15%); barium sulphate (about 5–10%); and organic acid (less than about 5%).

9. A method of applying corrosion protection to a corrosion susceptible item for marine use comprising the steps a) providing a predetermined quantity of uncured epoxy composition sufficient to envelop said item;
b) providing individual sections of a rigid cladding of collective size sufficient to encapsulate said epoxy composition on said item:
c) applying said uncured epoxy onto at least a select surface of said item to be protected;
d) applying said cladding sections juxtaposed to each other in a substantially encapsulating relation against the applied epoxy on said select surface;
e) providing clamping means about said applied cladding;
f) operating said clamping means so as to compress the uncured epoxy between the cladding and said select surface thereat with a level of compressive force sufficient to cause a quantity of the unglued epoxy to exude past said cladding sections; and
g) permitting said epoxy to cure to a predetermined hardness.

10. A method of applying corrosion protection in accordance with claim 9 in which said step of applying said epoxy includes concomitantly applying a first portion onto the select surface of said item and a second portion onto an interior surface of said cladding.

11. A method of applying corrosion protection in accordance with claim 10 in which said cladding comprises arcuate sections of filament glass resin pipe and said step of applying said cladding includes assembling said arcuate sections so as to substantially encapsulate said applied epoxy.

12. A method of applying corrosion protection in accordance with claim 11 including the step of providing centralizer segments on the interior surface of said cladding sections prior to the step of applying said cladding.

13. A method of applying corrosion protection in accordance with claim 12 in which said centralizer segments are comprised of predetermined lengths of epoxy and said step of providing said centralizer segments includes applying said segment epoxy uncured onto said cladding sections and permitting said segments to cure prior to the step of applying said cladding.

14. A method of applying corrosion protection in accordance with claim 13 in which said epoxy layer and said segment epoxy are of a like composition.

15. A method of applying corrosion protection in accordance with claim 11 in which said epoxy layer comprises a two-part mixture in substantially equal proportions of a polyamine converter and an epoxy resin operative to adhesively secure to said select surface portion.

16. A method of applying corrosion protection in accordance with claim 15 in which said epoxy resin is comprised in percent by volume of Bisphenol-F epoxy resin (about 80–95%); fumed silica (about 5–10%); and coloring matter (about less than 5%); and said converter is comprised in percent by volume of polyamine compound (about 80–95%); alkyl substituted amino-phenol (about 5–15%); barium sulphate (about 5–10%); and organic acid (less than about 5%).

17. A method of applying corrosion protection in accordance with claim 11 in which said protection is to be applied for restoration of an item existing in a marine environment and said steps of applying said epoxy and applying said cladding are preceded by the step of cleaning existing corrosion from the surface of the item onto which the protection is to be applied.

18. A method of applying corrosion protection in accordance with claim 17 in which said application steps are conducted at least partially underwater against an underwater section of said item and said epoxy is characterized by underwater curing capability.

19. A method of applying corrosion protection in accordance with claim 18 in which the water of said marine use comprises sea water and said protection is applied to at least a section of said item standing in the splash or tidal zones of said sea water.

20. A method of applying corrosion protection in accordance with claim 19 in which the item comprises a riser on an offshore platform for transmitting oil or gas recovery and said riser extends from near the sea bottom to an above water level location on said platform.

21. A system in accordance with claim 1 in which said juxtaposed cladding sections define a closely open seam therebetween into which uncured epoxy is exuded in response to the operation of said clamping means.

22. A system in accordance with claim 21 in which said seam is defined between opposed edge surfaces on the respective of the juxtaposed cladding sections and said edge surfaces are of substantially mirrored configuration.

23. A method in accordance with claim 9 in which the juxtaposed of said cladding sections define a closely open seam therebetween and operating said clamping means causes a quantity of epoxy to exude into said seam.

* * * * *